United States Patent [19]

Leicht

[11] 4,355,825

[45] Oct. 26, 1982

[54] MUDLINE SUSPENSION SYSTEM

[75] Inventor: Frederick M. Leicht, Houston, Tex.

[73] Assignee: Cameron Iron Works, Inc., Houston, Tex.

[21] Appl. No.: 197,113

[22] Filed: Oct. 15, 1980

[51] Int. Cl.[3] ..... E21B 19/10

[52] U.S. Cl. ..... 285/3; 166/115; 166/217; 285/140

[58] Field of Search ..... 285/3, 141, 140, 143, 285/142; 166/115, 208, 216, 217

[56] References Cited

U.S. PATENT DOCUMENTS

| | | | |
|---|---|---|---|
| 2,339,771 | 1/1944 | Davies | 285/348 X |
| 3,179,448 | 4/1965 | Jones | 285/146 |
| 3,893,717 | 7/1975 | Nelson | 285/3 |
| 3,918,747 | 11/1975 | Putch | 285/141 X |
| 4,139,059 | 2/1979 | Carmichael | 166/208 |

*Primary Examiner*—Thomas F. Callaghan
*Attorney, Agent, or Firm*—Vinson & Elkins

[57] ABSTRACT

A mudline suspension system for supporting a hanger and casing attached thereto from a wellhead member having an internal recess with an upwardly facing internal shoulder therein including a split ring latching member having fingers normally extending upwardly and outwardly with downwardly facing shoulders on the exterior of the fingers adapted to engage the internal shoulder on the wellhead when the latch member is positioned in said recess, and releasable means for retaining the latch member supported on the hanger during running, the latch member when in engagement with said internal shoulder providing a landing surface for the hanger which supports the hanger and casing.

8 Claims, 7 Drawing Figures

MUDLINE SUSPENSION SYSTEM

BACKGROUND

Mudline suspension systems for offshore wells are required to support substantial weights of casing from the casing hangers. The presence of mud or cement should not be allowed to cause failure. It is also preferred that an adequate by-pass for mud be provided and that no torque tool need be run.

U.S. Pat. No. 3,893,717 discloses a casing hanger which includes a plurality of spring loaded locking dogs or a split biased locking ring which engage in recesses in an outer well member to support a casing hanger. With the recesses filled with mud or cement difficulty is encountered in assuring that the locking dogs or split ring are moved into their seating area. In some cases the presence of mud or cement in these recesses allows the dogs or ring to only partly enter the recess and this greatly reduces the area of seating engagement which can result in seat failure or distortion of the hanger. Further, this device has limited available bearing area for the support of the hanger.

U.S. Pat. No. 3,497,243 discloses a hanger seat means including a ring with segments depending therefrom which is threaded in the hanger body and can be threaded downward to move the segments into seating position with a torque tool. Such rotation to provide seating is not always successful and requires the torque tool for setting.

U.S. Pat. No. 3,179,448 discloses a casing hanger with a (slip means) locking ring which has slots extending from the lower surface terminating short of the top and slots extending from the top surface terminating short of the bottom. The exterior of the ring is cylindrical with teeth and the interior is tapered to be forced outward by the expander. Slips have long been used for supporting packers and anchors in well bores but it is preferred that the extremely heavy loads of casing hangers not be supported on slips.

U.S. Pat. No. 2,339,771 merely discloses a coupling having a tapered sealing ring with alternate upper and lower slots.

SUMMARY

The present invention relates to an improved mudline suspension system for supporting casing within a well. The improved system includes a hanger, a wellhead member and a latching member which is a split ring and is generally frusto-conical in shape, the wellhead member having a recess with a shoulder therein, and the hanger having releasable means for retaining the latching member on the hanger during running, the latching member having a projection with a shoulder which expands into engagement with the wellhead shoulder when the latching member is adjacent the wellhead recess so that the latching member is held in position supporting the hanger in the wellhead member. A shear means permits lowering and seating the hanger.

An object of the present invention is to provide an improved mudline well casing suspension system which will support large casing weights and is fully retrievable with a simple upward pull.

Another object is to provide an improved mudline well casing suspension system which assures proper seating with mud, cement or other well trash in the seating groove.

Another object is to provide an improved mudline well casing suspension system which can use standard casing hangers.

Still another object is to provide an improved mudline well casing suspension system which does not require rotation for setting and allows for washing out cement above the running tool without its disengagement from the hanger.

A still further object is to provide an improved mudline well casing suspension system with an improved latch mechanism which is weight set, is run with the hanger in a stored position and expands into the landing recess when moved into registry therewith to provide a substantial, tapered landing seat.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
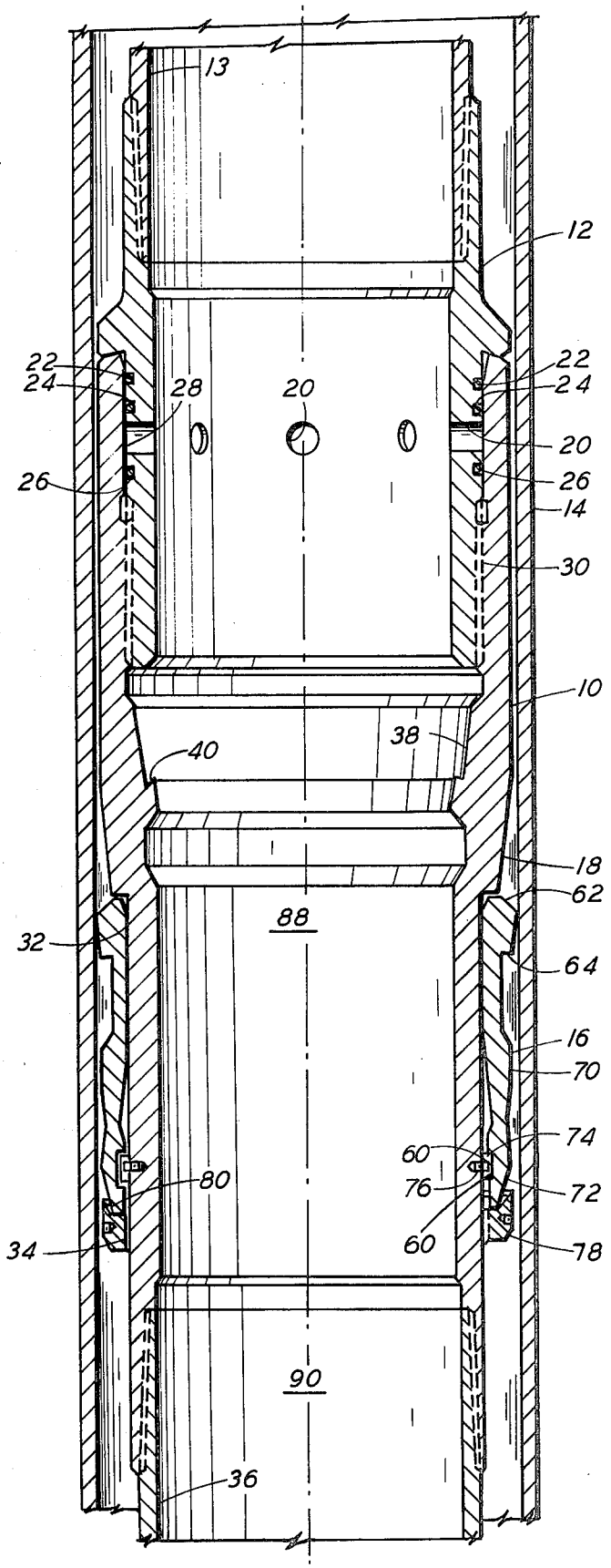
FIG. 1 is a sectional view of the improved hanger and latching member of the present invention being run in a well.

As shown in FIG. 1, hanger 10 supported on running tool and casing connector 12 is being run on casing 13 through riser 14. Latching member 16 surrounds hanger 10 below downwardly facing landing surface 18. Tool 12 is threaded into hanger 10 on left-hand threads 30 and includes washing ports 20 which on make-up are below the upper end of hanger 10 so that seals 22, 24 and 26 seal above and below ports 20 against the interior surface 28 of hanger 10 above threads 30.

Hanger 10 is generally tubular in shape with a recessed cylindrical surface 32 below landing surface 18 and external threads 34 at the lower end of surface 32. Casing 36 is threaded into the lower end of hanger 10 as shown. Hanger 10 includes internal recess 38 which has upwardly facing shoulder 40 therein for the landing of the next smaller hanger (not shown) therein.

Figure 2:
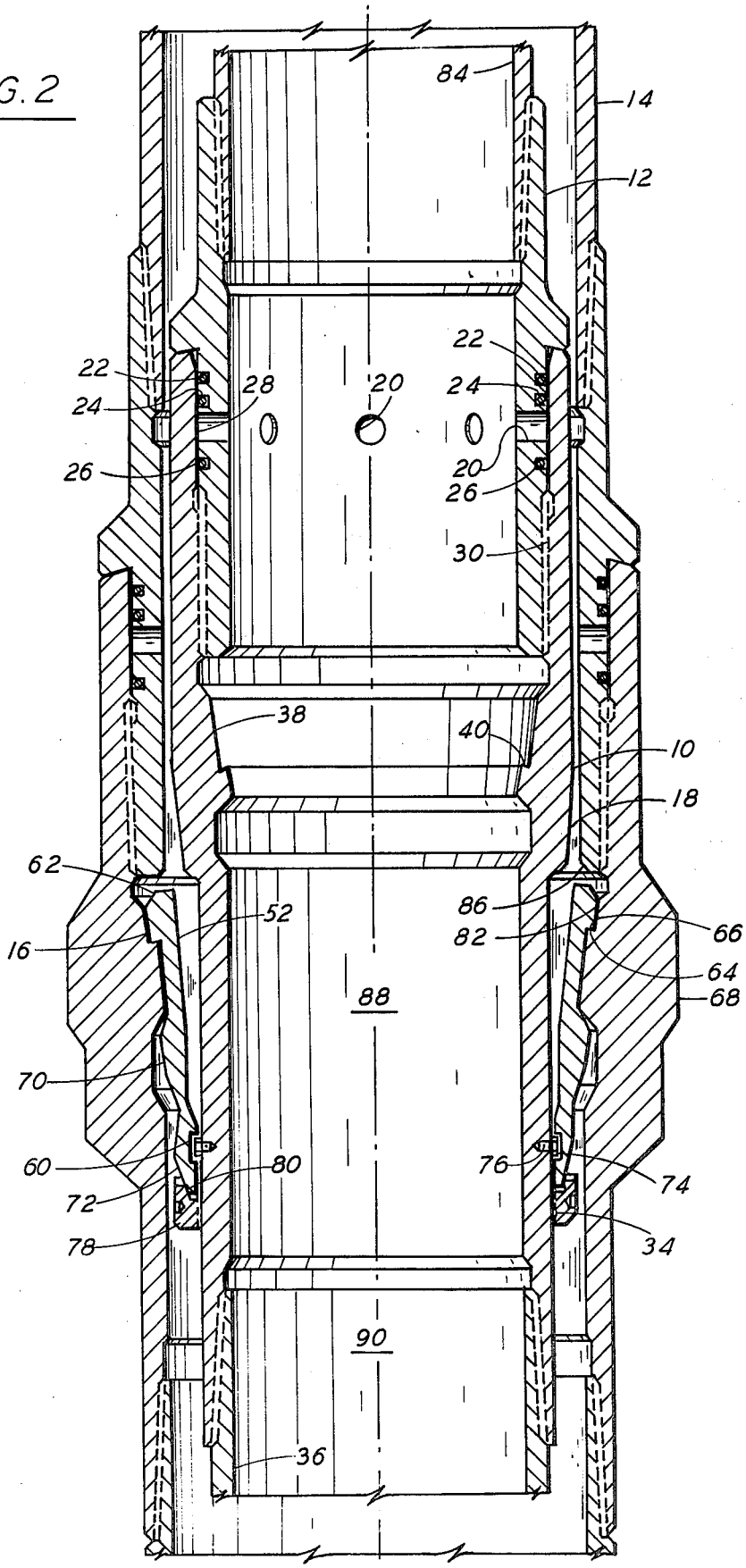
FIG. 2 is a sectional view of the improved suspension system with the latching member engaged in the landing recess of the wellhead member.
Figure 5:
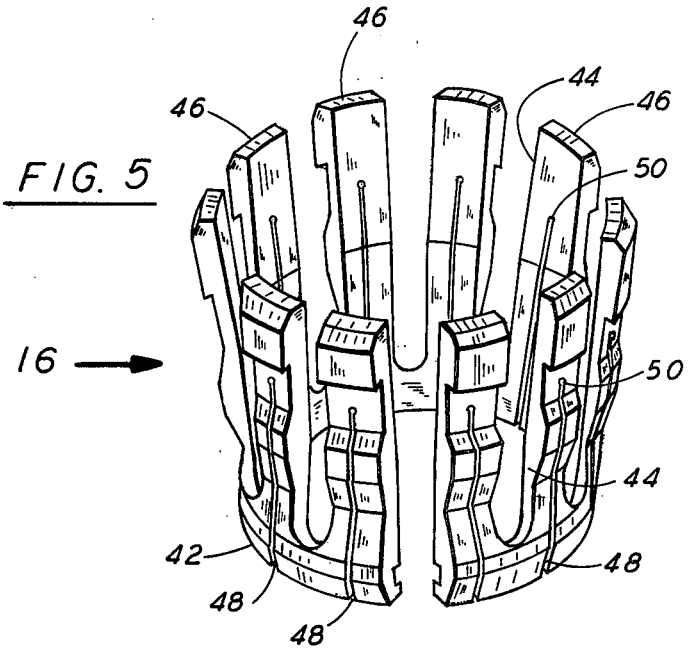
FIG. 5 is a perspective view of the improved latching member of the present invention.
Figure 7:
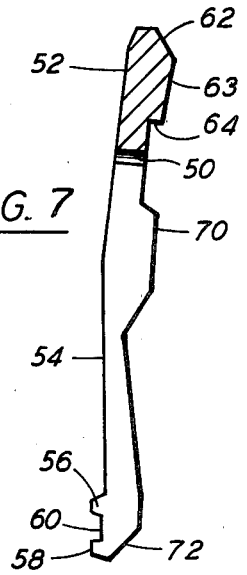
FIG. 7 is a sectional view taken along line 7—7 in FIG. 6.
Figure 6:
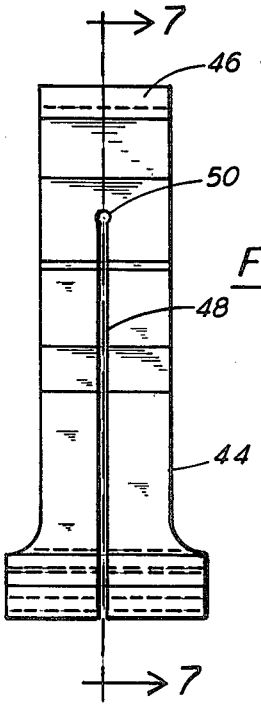
FIG. 6 is an external view of one segment of the latching member with the remainder broken away.

Latching member 16 as best seen in FIGS. 5, 6 and 7 is a split ring 42, preferably of metal, with a plurality of slots 44 open at the top and extending downward to a position near the bottom of ring 42, to provide a plurality of upwardly and outwardly extending fingers 46. Slots 48 open at the bottom of ring 42 and extend upwardly through the central portion of each of fingers 46 to terminate in holes 50 below the upper end of fingers 46. Ring 42 is split as shown and when free standing or unrestricted its ends are spaced apart and it has a frusto-conical shape or upwardly diverging shape as best seen in FIG. 5. The interior of ring 42 includes upper tapered landing surface 52, interior surface 54 and lower annular ribs 56 and 58 with annular groove or recess 60 therebetween. The exterior of ring 42 includes upper bevel 62, surface 63, annular shoulder 64 which faces downwardly and is tilted to face slightly inwardly to mate with shoulder 66 on the interior of wellhead member 68 as shown in FIG. 2 and hereinafter described in detail. Below shoulder 64, ring 42 includes annular projection 70 and lower tapered surface 72. As can be seen from FIGS. 5, 6 and 7, latching member 16 is a hollow, generally frusto-conical metallic member having a larger diameter upper end than the lower end and a gap permitting circumferential contraction of the member.

For running, latching member 16 is positioned around surface 32 of hanger 10 with ring 74 which is secured to hanger 10 by shear pins 76 positioned in recess 60 between ribs 56 and 58. Retainer 78 is threaded onto external threads 34 and includes annular recess 80 into which the lower end of ring 42 is positioned to retain latching member in close surrounding relationship to surface 32 of hanger 10. As can be seen from FIG. 1 latching member 16 in running position is close to surface 32, as described, with the upper outer corners of fingers 46 sliding on the interior of riser 14 as hanger 10 is lowered with latching member 16 thereon.

Figure 3:
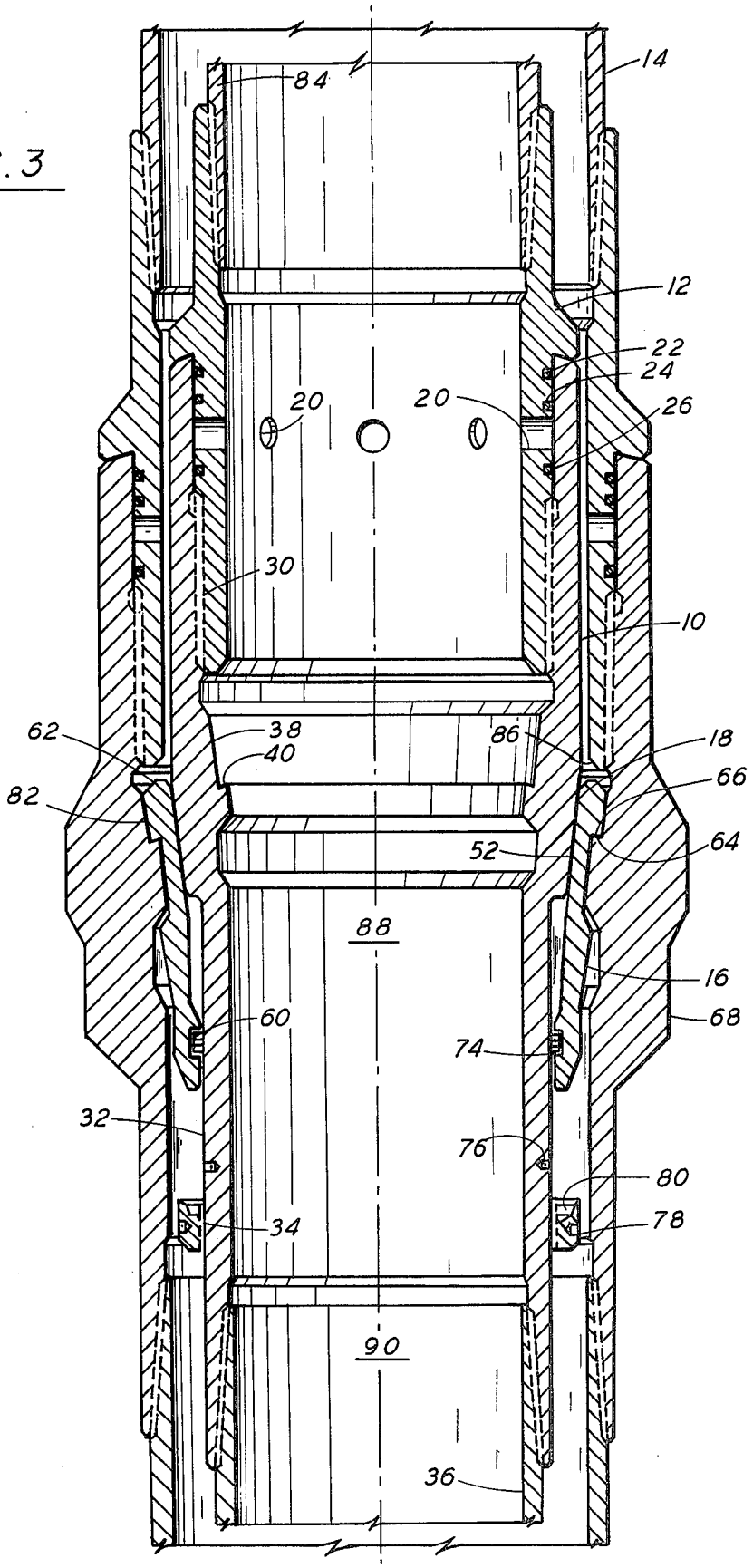
FIG. 3 is another similar sectional view of the hanger landed in the wellhead member.

The lowering of hanger 10 proceeds until latching member 16 reaches recess 82 on the interior of wellhead member 68 at which point, as shown in FIG. 2, it is free of the restraint of riser 14 and moves outward into recess 82. A further short movement brings shoulder 64 into engagement with shoulder 66 and surface 63 seats in recess 82. With latch member 16 seated in wellhead member 68, further lowering of hanger 10 causes pins 76 to shear allowing hanger 10 to slide through latching member 16 until landing surface 18 of hanger 10 engages landing surface 52 on latching member 16 as shown in FIG. 3. Even a slight engagement of shoulder 64 on shoulder 66 is sufficient to retain latching member 16 in recess 82 and to shear pins 76. As hanger 10 is lowered through latching member 16, landing surface 18 engages surface 52 of latching member 16 to force latching member 16 fully into recess 82 even if mud, cement or other well trash is in recess 82. The wedging action of surface 18 on surface 52 provides sufficient force to assure full seating of latching member 16 in recess 82. In this position, hanger 10 and casing 36 are supported from wellhead member 68 by latching member 16. If desired, the string including hanger 10, latching member 16 and casing 36 may be recovered by raising casing 13. This lifts tool 12, hanger 10, casing 36 and retainer 78. The lower end of latching member 16 is caught in recess 80 of retainer 78 and latching member 16 is lifted until bevel 62 engages inwardly and upwardly tapered surface 86 on the interior of wellhead member 68. Surface 86 cams or wedges the upper end of latching member inwardly to its running position so that it can be pulled upward through riser 14. Any outward movement of latching member 16 at joints in riser 14 is overcome by latching member being wedged inwardly when bevel 62 engages the lower inner edge of the joint.

Figure 4:
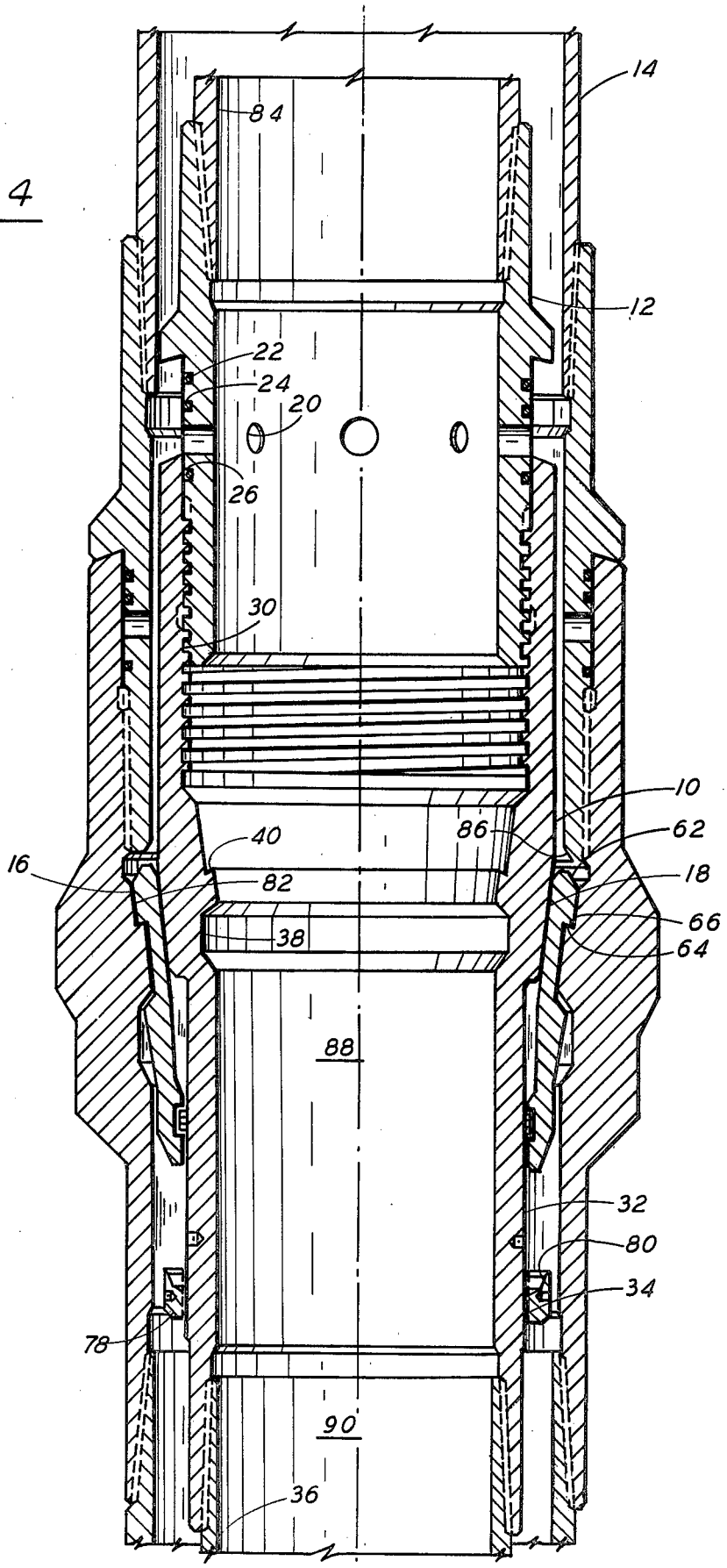
FIG. 4 is a view similar to FIG. 3 with the running tool moved upward to open the washing ports.

When hanger 10 has been landed, then cementing may proceed to set casing 36. Flow upwardly through latching member 16 is through slots 44. Slots 44 in latching member 16 provide sufficient opening when latching member 16 and hanger 10 are seated so that the cementing flow is not restricted. Hanger 10 has a full open bore 88 of substantially the same diameter as bore 90 of casing 36. At the completion of cementing, casing 13 and running tool 12 are backed off approximately six turns to the right to rotate tool 12 with respect to hanger 10. This results in partial unthreading of threads 30 to clear ports 20 above the upper end of hanger 10 as shown in FIG. 4. Further circulation is through ports 20 and provides a washing out of the cement above running tool 12 with the wash water flowing up in the annulus. After the pump is turned off, casing 13 and running tool 12 are rotated six turns to the left to close ports 20. In this position, casing 36 and hanger 10 are cemented in position and further drilling may proceed therethrough.

What is claimed is:

1. A mudline well casing suspension system comprising a wellhead member having an internal recess with an upwardly facing shoulder at the desired level for landing a casing hanger, a hanger having an outer downwardly facing tapered landing surface, and a hollow, generally frusto-conical metallic latching member having an upper end of larger diameter and a lower end of smaller diameter, said latching member also having a gap permitting circumferential contraction of the latching member, an external, downwardly facing shoulder for engaging said wellhead member shoulder, first slots extending from said upper end to near said lower end, second slots between said first slots extending from said lower end to near said upper end and an internal tapered landing surface to receive and support said hanger landing surface when said shoulders are interengaged, said hanger tapered landing surface engaging said tapered landing surface on said latching member to force said latching member shoulder into full engagement with said wellhead member shoulder and transmitting the weight on said hanger to said latching member, said hanger tapered landing surface in the assembled position being in full engagement with said tapered landing surface on said latching member both above and below said latching member shoulder.

2. A system according to claim 1 wherein said first slots are wider than said second slots.

3. A system according to claim 1 including means for releasably supporting said latching member closely around the exterior of said casing hanger for lowering the hanger and latching member in the wellhead member.

4. A system according to claim 3 wherein said releasable supporting means includes shear means located internally near the lower end of said latching member.

5. A system according to claim 4 wherein said latching member has an internal groove near the lower end and said shear means includes a ring in said groove and an inwardly directed shear pin in said ring.

6. A mudline well casing suspension system comprising a wellhead member having an internal recess with an upwardly facing shoulder at the desired level for landing a casing hanger, a hanger having an outer downwardly facing tapered landing surface, a split ring latching member having an upwardly diverging frusto-conical free shape, means for releasably supporting said latching member closely around the exterior of said casing hanger for lowering the hanger and latching member in the wellhead member, said latching member having an outer downwardly facing shoulder whereby when the latching member registers with the internal recess on the wellhead member, it moves outward to seat its shoulder on the wellhead member shoulder and provide an upwardly facing landing surface for engaging and supporting the hanger landing surface, said hanger tapered landing surface engaging said tapered landing surface on said latching member to force said latching member shoulder into full engagement with said wellhead member shoulder and transmitting the weight on said hanger to said latching member, said hanger tapered landing surface in the assembled position being in full engagement with said tapered landing surface on said latching member both above and below said latching member shoulder.

7. A system according to claim 6 wherein said releasable supporting means includes a retainer ring threaded onto said hanger and having an upwardly facing recess receiving the lower end of said latching member, and shear means retaining the lower end of said latching member in said retainer ring recess.

8. A system according to claim 7 wherein said shear means includes a ring positioned within an internal groove in said latching member, and a shear pin securing said ring to said hanger at a position to releasably retain the lower end of said latching member within said retainer ring recess.

* * * * *